US005415007A

United States Patent [19]

Eng

[11] Patent Number: 5,415,007

[45] Date of Patent: May 16, 1995

[54] FABRIC USED IN TROUSERS AND TROUSER LEGS TO SERVE AS SAW GUARD INSERTS

[75] Inventor: Kjell Eng, Mullsjö , Sweden

[73] Assignee: Eng-Tex AB, Sweden

[21] Appl. No.: 208,785

[22] Filed: Mar. 11, 1994

Related U.S. Application Data

[63] Continuation of Ser. No. 915,691, Jul. 21, 1992, abandoned.

[30] Foreign Application Priority Data

Jan. 31, 1990 [SE] Sweden ..... 9000325

[51] Int. Cl.[6] ..... D04B 21/18

[52] U.S. Cl. ..... 66/192; 66/190; 66/169 R; 2/22; 428/230

[58] Field of Search ..... 2/16, 22, 23, 2; 66/190, 193, 178 A, 169 R, 110, 171, 177, 192, 193; 428/230, 231, 225, 224, 227

[56] References Cited

U.S. PATENT DOCUMENTS

| | | | |
|---|---|---|---|
| | 3/1992 | Elverskog | 2/22 |
| 3,430,465 | 3/1969 | Porter | 66/193 |
| 3,570,482 | 3/1971 | Emoto | 66/193 |
| 3,757,541 | 9/1973 | Frölich et al. | 66/193 |
| 3,864,945 | 2/1975 | Frölich | 66/193 |
| 4,279,956 | 7/1981 | Bartels | 2/22 X |
| 4,351,065 | 9/1982 | Bouchard | 2/23 |
| 4,604,315 | 8/1986 | McCall et al. | 66/178 A |

FOREIGN PATENT DOCUMENTS

| | | | |
|---|---|---|---|
| 20389935 | 10/1990 | European Pat. Off. . | |
| 1055741 | 10/1953 | Germany | 66/190 |
| 87046405 | 5/1989 | Sweden . | |
| 2219727 | 12/1989 | United Kingdom . | |

*Primary Examiner*—Clifford D. Crowder
*Assistant Examiner*—Larry D. Worrell, Jr.
*Attorney, Agent, or Firm*—Harness, Dickey & Pierce

[57] ABSTRACT

A fabric intended to serve as an insert in working trousers or trouser legs for power-saw operators. The fabric consists of two layers, viz. a carrier layer or passive layer, wherein the threads interconnect the threads of the active layer, i.e. the layer wherein on account of the contraction of the passive layer threads caused by suitable treatment of them, the threads of the active layer are forced to take on a sinuous configuration whereby at their contact with the saw chain the sinuous sections will be caught by the chain, and the threads of the active layer by pulled out and thus so heavily oppose the movement of the saw chain that the latter is immobilized.

8 Claims, 3 Drawing Sheets

FABRIC USED IN TROUSERS AND TROUSER LEGS TO SERVE AS SAW GUARD INSERTS

This is a continuation of U.S. patent application Ser. No. 07/915,691, filed Jul. 21, 1992, now abandoned, which was a national phase of PCT application No. PCT/SE90/00873, filed Dec. 27, 1990, which was based on Ser. No. 9000325-2, filed Jan. 31, 1990, in Sweden.

BACKGROUND OF THE INVENTION

The invention concerns a fabric which is intended to be used as a trouser and trouser leg insert to serve as a protection against power-driven chain saws.

The use of power-driven chain saws in mechanised forestry work contributes considerably to the increased risks for damages to the user. Should he loose control of the saw and in consequence thereof the guide bar hit his leg—which is very common—very severe damages may be caused. Various suggestions therefore have been presented, involving the application of specially designed inserts in the trousers or the trouser legs as a protection against damages of this nature. Although the protective items available up till now have increased the security considerably much remains to be done before the protection that is accessible to the saw-operator may be regarded as offering satisfactory safety.

SUMMARY OF THE INVENTION

The purpose of the present invention is to provide the saw-operator with such improved protection by preventing or reducing the injuries. The purpose is to arrest the saw chain before the latter has had time to hurt the saw-operator's legs. This is achieved in the manner appearing from the characterizing clause of claim 1. Further characteristics of the invention will appear from the appended claims.

BRIEF DESCRIPTION OF THE DRAWINGS

The invention will be described in closer detail in the following with reference to the accompanying drawings.

DETAILED DESCRIPTION OF THE PREFERRED EMBODIMENTS OF THE INVENTION

Figure 1:
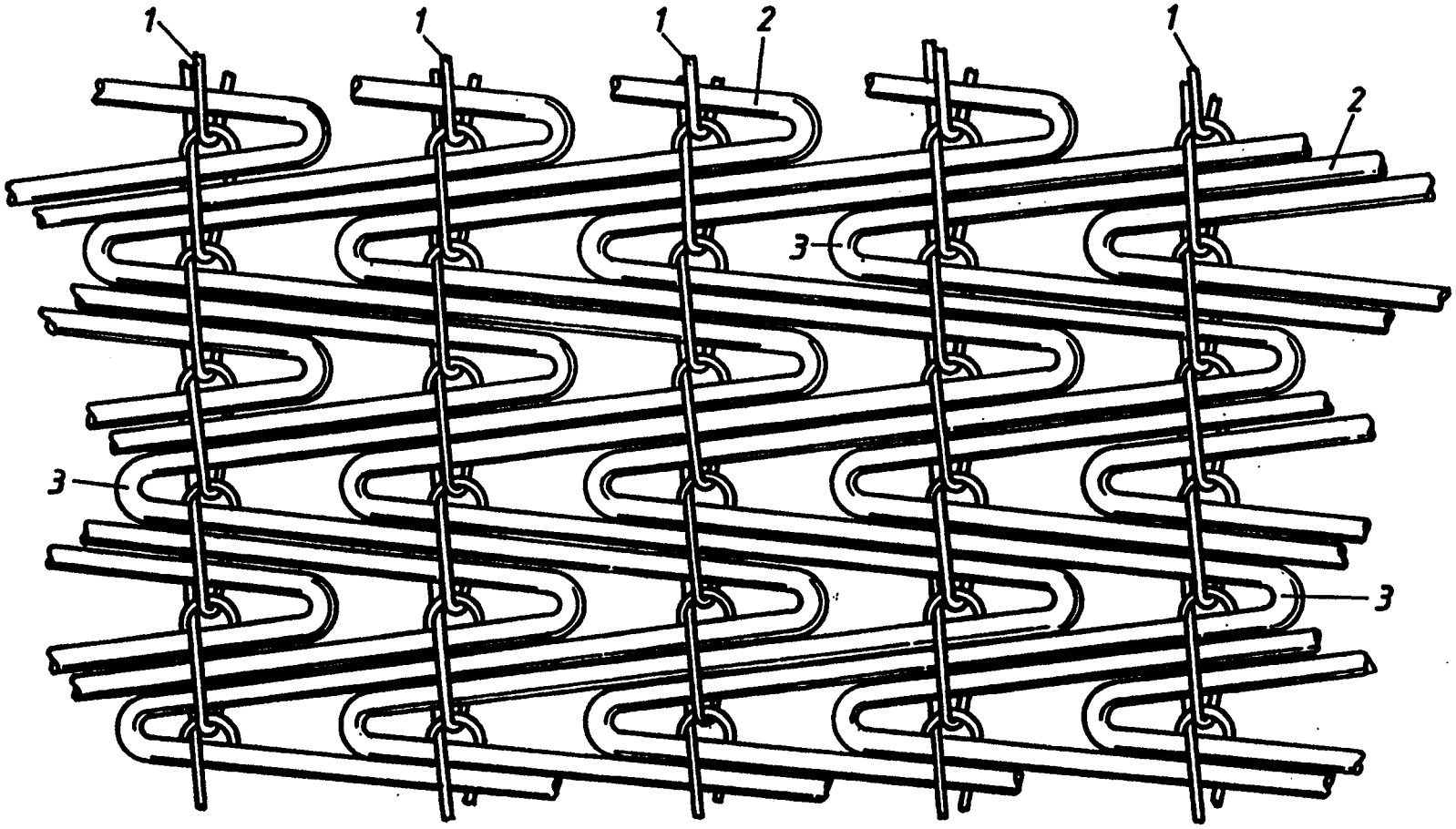
FIGS. 1–3 illustrate three different embodiments of fabrics designed in accordance with the teachings of the subject invention to give the effect desired.

In the fabric illustrated in FIG. 1 the thin-diameter threads 1 form a passive layer and the larger-diameter threads 2 an active layer, or, expressed in a different way, the passive thread layer supports the active thread layer and does not take part in arresting the saw chain. The threads forming the-active layer extend in a tortuous or serpentine pattern 3 which in reality are positioned on top of the and consequently they will instantaneously be caught by the saw chain upon their contact with the latter and be pulled out, said threads having a sufficient length in relation to the length of the insert to ensure that they will not break. However, their bond to the threads 1 in the passive layer is sufficiently strong to ensure that when the trousers are used or washed they will remain in position.

Obviously, this embodiment may be modified in a variety of different ways. The essential consideration is that the passive layer be formed by threads that maintain the threads of the active layer in position when the garment is used and, above all, when it is washed, and that the active-layer threads have such a length that they will take on a tortuous pattern or that as a result of texturizing they are imparted the desired length, allowing them to be captured by the saw chain upon their contact with the latter and that they are sufficiently strong to cause the binder yarn in the passive layer to break and thereby arrest the saw chain.

Figure 2:
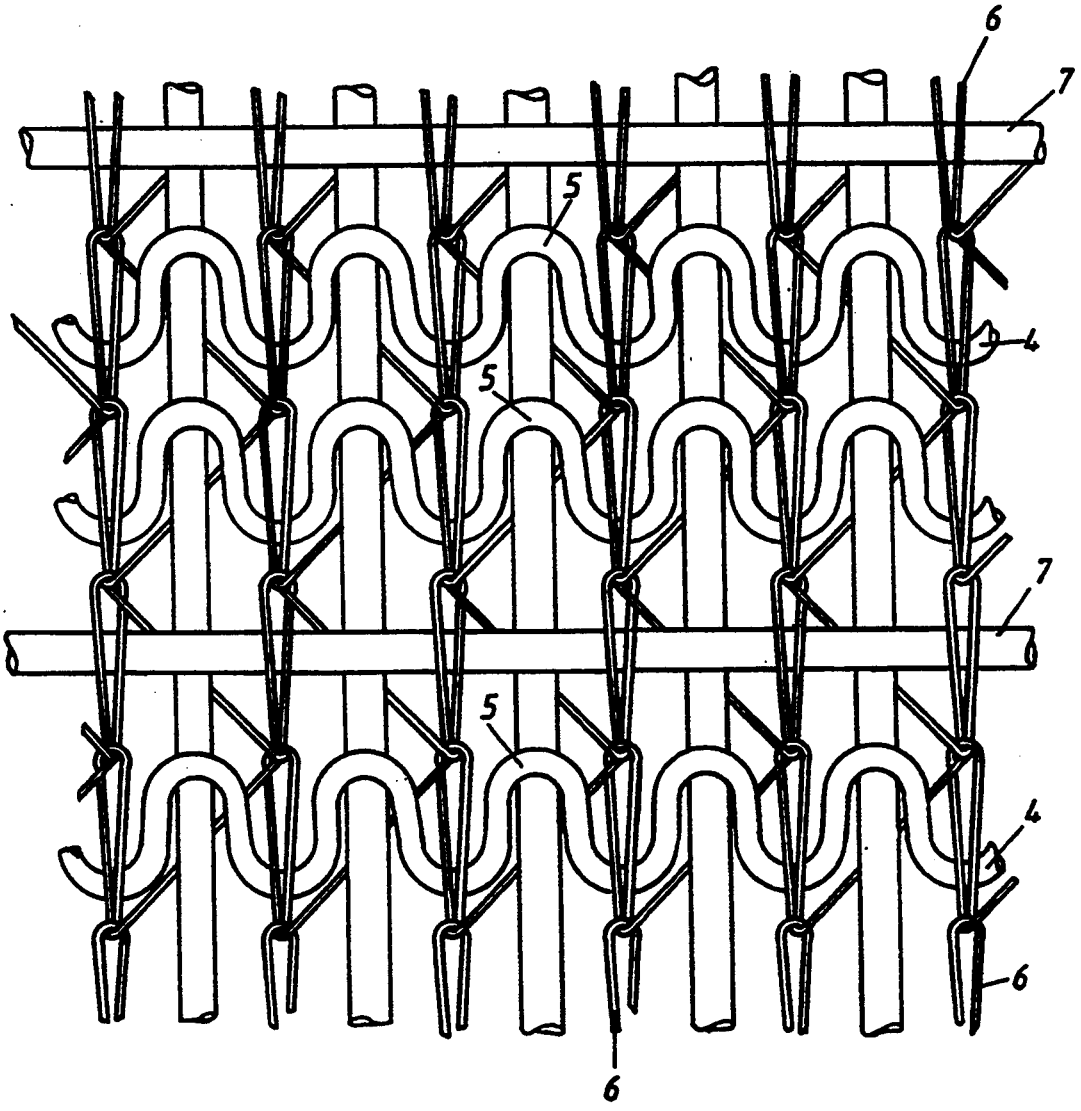

FIG. 2 illustrates another type of fabric, wherein the coarse yarns 4 form a tortuous or serpentine pattern 5. Like in the embodiment illustrated in FIG. 1 a passive layer of binder threads 6 are formed also in accordance with the embodiment of FIG. 2 but in the latter case threads 7 which are shrinkable for instance when exposed to a heat treatment are bound into the weave. By heat-shrinking the threads 7 the yarns 4 which consist of a non-shrinking material will take on a tortuous pattern 5 having the same function as the tortuous pattern 3 of the threads in accordance with the embodiment of FIG. 1.

Figure 3:
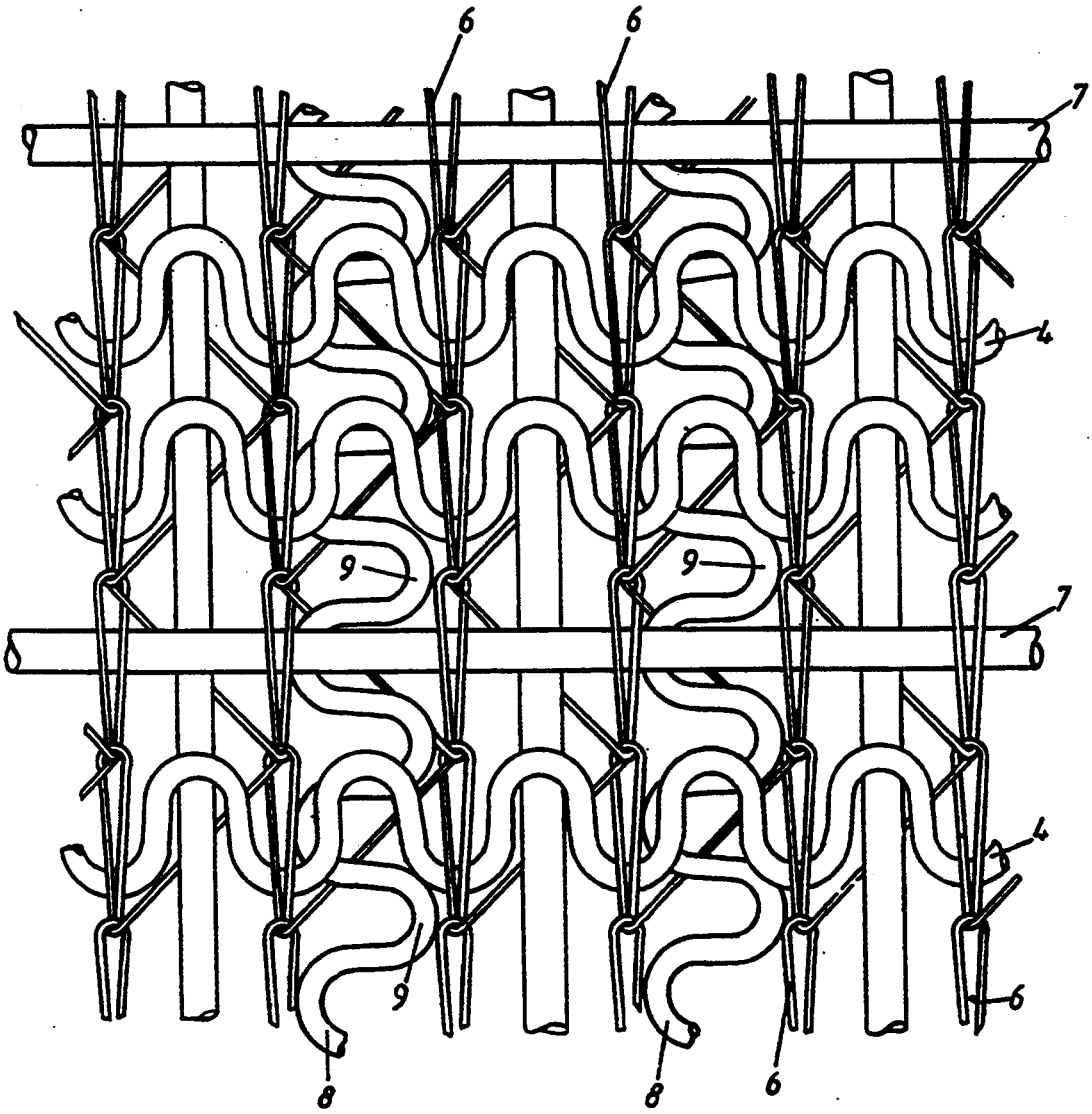

The embodiment of FIG. 3 is similar to that of FIG. 2 in as much as it comprises threads 7 of a shrinkable material. Also this embodiment comprises a passive layer formed by threads 6, shown as thin threads in the drawing figures and serving as binder threads. In addition, the embodiment in accordance with FIG. 3 comprises threads 8 of a non-shrinkable material, similar or identical to that of threads 4, so that also the threads 8 will take on a tortuous or serpentine configuration 9 the tortuous portions of which may be caught by the saw chain upon contact with the latter.

The fabric or weave in accordance with the invention should be applied in several layers, preferably 3–12, on the internal face of working trousers or trouser legs. Practical tests have given unexpectedly good result and in cases where injuries have been inflicted, they have been less serious and consequently have healed in about a third of the time necessary before the use of protective inserts of the kind described in the aforegoing was initiated.

The embodiments as illustrated and described are to be regarded only as practical examples and a variety of modifications are possible within the scope of the appended claims. For instance, instead of a shrinkable thread elastic threads may be used in order to make the thread or threads in the active layer take on a tortuous shape.

I claim:

1. A fabric for protection against injury from a saw blade, comprising:

a weft yarn;

a warp yarn floating over the weft yarn;

the weft yarn and the warp yarn defining the plane of said fabric and said fabric having a surface dimension;

a knitting yarn disposed around the weft yarn and the warp yarn, the knitting yarn defining a plurality of spaced apart restraining stitches;

at least one of the weft yarn and the warp yarn slidingly received through said restraining stitches and defining a serpentine structure having a greater lineal dimension than the surface dimension of the fabric that contains it;

said serpentine structure being held by said restraining stitches such that when the fabric is engaged by a saw blade said serpentine structure readily pulls outwardly from the plane of said fabric through at least one of said restraining stitches to entangle the saw blade and retard its movement.

2. The fabric of claim 1 wherein said weft yarn comprises a substantially shrinkable yarn component and a substantially nonshrinkable yarn component and wherein said serpentine structure is defined by said substantially nonshrinkable yarn component.

3. The fabric of claim 1 wherein said weft yarn comprises a texturized yarn component and a nontexturized yarn component and wherein said serpentine structure is defined by said texturized yarn component.

4. The fabric of claim 1 wherein said warp yarn comprises a first substantially shrinkable and texturized yarn component and a second substantially nonshrinkable and nontexturized yarn component and wherein said serpentine structure is defined by said second yarn component.

5. The fabric of claim 1 wherein said warp yarn comprises a substantially shrinkable yarn component and a substantially nonshrinkable yarn component and wherein said serpentine structure is defined by said substantially nonshrinkable yarn component.

6. The fabric of claim 1 wherein said warp yarn comprises a texturized yarn component and a nontexturized yarn component and wherein said serpentine structure is defined by said texturized yarn component.

7. The fabric of claim 1 wherein said warp yarn comprises a first substantially shrinkable and texturized yarn component and a second substantially nonshrinkable and nontexturized yarn component and wherein said serpentine structure is defined by said second yarn component.

8. The fabric of claim 1 wherein said serpentine structure is held in seriatim by said retaining stitches such that when pulled outwardly by an engaged saw blade said serpentine structure slides through said retaining stitches in seriatim, thereby developing pulling friction with said retaining stitches that gradually increases as the length of said serpentine structure pulled outwardly from the plane of the fabric increases.

* * * * *

UNITED STATES PATENT AND TRADEMARK OFFICE

CERTIFICATE OF CORRECTION

PATENT NO. : 5,415,007

DATED : May 16, 1995

INVENTOR(S) : Kjell Eng

It is certified that error appears in the above-identified patent and that said Letters Patent is hereby corrected as shown below:

ON THE TITLE PAGE, in the U.S. PATENT DOCUMENTS, Item [56], line 1, before "3/1992" insert – 5,095,544 –.

Column 1, line 56, after "the" (2nd occurrence) delete "-".

Column 1, line 58, after "the" insert – knit –.

Signed and Sealed this

Seventeenth Day of October, 1995

*Attest:*

*Attesting Officer*

Bruce Lehman

BRUCE LEHMAN

*Commissioner of Patents and Trademarks*